US005918613A

United States Patent [19]

Larson

[11] Patent Number: 5,918,613

[45] Date of Patent: Jul. 6, 1999

[54] DETACHABLE TEE-TOP FOR BOAT CENTER CONSOLES

[75] Inventor: Don Larson, Tampa, Fla.

[73] Assignee: Bimi-Tee Top Company, Tampa, Fla.

[21] Appl. No.: 09/031,622

[22] Filed: Feb. 27, 1998

[51] Int. Cl.[6] ..... E04H 15/34

[52] U.S. Cl. ..... 135/88.01; 114/361; 135/120.1; 135/120.4; 135/141; 135/155

[58] Field of Search ..... 135/96, 141, 148, 135/149, 151, 152, 153, 155, 156, 120.1, 120.4, 120.3, 900, 901, 88.01; 297/188.2, 188.18; 114/361

[56] References Cited

U.S. PATENT DOCUMENTS

| | | | |
|---|---|---|---|
| 653,621 | 7/1900 | Dubham | 135/87 |
| 743,827 | 11/1903 | Campbell | 135/151 |
| 870,541 | 11/1907 | Brumley | 135/96 |
| 886,222 | 4/1908 | Koiner et al. | 135/151 |
| 937,529 | 10/1909 | Hook | 135/90 |
| 1,162,540 | 11/1915 | Adams | 135/96 |
| 1,746,833 | 2/1930 | Hermansen | 135/153 |
| 2,505,520 | 4/1950 | Bills | 135/151 |
| 2,811,977 | 11/1957 | McClish | 135/901 |
| 3,032,046 | 5/1962 | Coonradt . | |
| 4,063,318 | 12/1977 | Nicholson | 135/96 |
| 4,170,242 | 10/1979 | Caso | 135/96 |
| 4,300,253 | 11/1981 | Anderson | 135/901 |
| 4,683,900 | 8/1987 | Carmichael . | |
| 4,825,889 | 5/1989 | Monteith | 135/88 |
| 5,096,257 | 3/1992 | Clark | 135/96 |
| 5,133,378 | 7/1992 | Tanasychuk | 135/148 |
| 5,203,363 | 4/1993 | Kidwell et al. | 135/96 |
| 5,240,020 | 8/1993 | Byers | 135/155 |
| 5,520,139 | 5/1996 | King et al. . | |
| 5,579,797 | 12/1996 | Rogers . | |

OTHER PUBLICATIONS

Nov. 1997 Soundings — The Nation's Boating Newspaper.
1996 Mako Marine — You've Got The Mako Advantage.
Nov. 1997 Dusky Marine Inc. — Only The Ficht Survive.

*Primary Examiner*—Christopher Kent
*Assistant Examiner*—Phi Dieu Tran A
*Attorney, Agent, or Firm*—James E. Larson; Larson & Larson, P.A.

[57] ABSTRACT

A detachable tee-top includes a framework having base portions fastened to two opposed sides of a center console of a boat and consisting of elongated tubes having fasteners fastened to the center console by threaded fasteners. The framework includes a further elongated tube for each of the elongated tubes making up the base portions with each of the further elongated tubes being sized to be slidably receivable within the upwardly facing opening of a respective one of the base portion elongated tubes. Thus, the further elongated tubes or pipes may easily be removed from the base portion elongated tubes when it is desired to remove the detachable tee-top from the associated vessel. The tee-top also includes a horizontally oriented support frame for a cover. Flexible straps attached to this support frame are stretched downwardly and attached to the base portions of the device to support the frame in high wind conditions. The framework is disclosed in two alternative configurations of elongated tubes. The support frame includes a single centrally disposed horizontal brace or, in a second larger embodiment, a second centrally disposed horizontal brace provided parallel to the first-mentioned horizontal brace. One end of the cover is fastened at one end of the support frame and the cover may be extended over the remainder of the support frame whereupon straps may be stretched and extended to a desired configuration to hold the cover in its assembled configuration and permit flow of air under the cover.

20 Claims, 9 Drawing Sheets

DETACHABLE TEE-TOP FOR BOAT CENTER CONSOLES

BACKGROUND OF THE INVENTION

The present invention relates to a detachable tee-top for a boat with a center console. More particularly the invention refers to a detachable lightweight tee top that can be universally installed on any boat with a center console.

In the prior art, frameworks are known for mounting on various areas of a boat to support a cover over a portion of the vessel in which it is mounted, including areas where the user is operating the boat. However, devices of this general class known by the applicant generally have severe limitations. Broadly, such frameworks fall into two categories. The first category, commonly called tee top, consists of individually designed frameworks that attach to the center console. The covers are inflexibly secured to the frameworks. As a result, strong forces are transferred to the frameworks at high wind speed. Consequently, they are constructed of heavy gauge aluminum or stainless steel pipe, cut, bent and welded to fit each individual boat. The custom built tee-top is fixed by design and cannot be lowered. They are expensive to build, heavy and generally unavailable to boaters in many areas of the country. A boat with a custom built tee-top cannot be stored in a standard size garage or a commercial covered marine storage facility because of the fixed height of the welded top. Custom built tee-tops limit passage under fixed bridges thus denying access to many waterways. The second category, commonly called Bimini-tops, consist of a framework of aluminum tubes, straps and canvas that attach to and cover the gunnels of the boat making it difficult to maneuver on board. For example, the Bimini-top is always mounted on the gunnels in such a way as it hampers the freedom of movement of the boater or fisherman. As a result, with the top extended to cover the center it is difficult and sometimes impossible to boat many commonly caught fish that grow large enough to require unrestricted ability to maneuver fishing tackle and line.

The following prior art is known to Applicant:

U.S. Pat. 3,032,046 to Coonradt discloses a boat awning that is supported on the gunwale of a boat on one side thereof. While the Coonradt boat awning is easily removable through rotation of a set screw, such support on only one side of the boat lacks sufficient strength and provides an unbalanced weight on the boat. The present invention differs from the teachings of Coonradt as contemplating attachment of supports for a cover on either side of the center console of a boat with structure allowing easy removal of the cover therefrom. U.S. Pat. No. 4,683,900 to Carmichael discloses a boat canopy that is mounted on a boat such as a canoe through attachment to the opposed gunwales of the vessel. Flexible resilient connector straps also attach the frame to the gunwale. The present invention differs from the teachings of Carmichael as contemplating attachment of supports for a cover on either side of the center console of a boat with structure allowing easy removal of the cover therefrom.

U.S. Pat. No. 5,520,139 to King et al. discloses a boat canopy clamped to opposed gunwales of a boat. Such a canopy could not withstand stresses induced by a high speed boat. The present invention differs from the teachings of King et al. as contemplating attachment of supports for a cover on either side of the center console of a boat with structure allowing easy removal of the cover therefrom, but with the ability to withstand high boat speed up to 60 mph. U.S. Pat. No. 5,579,797 to Rogers discloses a foldable canopy support having an elongated mast and a longitudinal mast axis with a horizontal frame supporting a covering material and teaching use of a relatively thin strut holding the cover on a side opposite to the solid support thereof. The present invention differs from the teachings of Rogers as contemplating a boat cover having two substantially equal-sized side supports having base portions fixed to the sides of a center console and allowing the remainder of the cover to be removed therefrom.

Advertising pages for the Mako 252, the Dusky 256, the Canyon Runner 260, the 22 foot Key Largo, a Glacier Bay's catamaran, and a Cobra catamaran all show various examples of covers for boats including boats with center consoles. However, from the photographs and descriptions shown, Applicant is unaware of any teaching or suggestion in these advertising and magazine materials to teach or suggest all of the features and aspects of the present invention including mounting of base portions of a support for a cover to either side of a center console with the remainder of the cover being detachable therefrom and with other advantageous features including flexible straps used to hold the cover in its mounted configuration.

SUMMARY OF THE INVENTION

The present invention is directed to a detachable tee-top for boat center consoles. It includes the following interrelated objects, aspects and features:

(1) In a first aspect, the present invention contemplates a framework having base portions that are suitably fastened to two opposed sides of a center console of a boat. These base portions consist of elongated tubes having fasteners mounted thereon that are adapted to be fastened to the opposed sides of a center console by a set of clamps and suitable threaded fasteners. These elongated tubes are upwardly and downwardly open for a purpose to be described hereinafter.

(2) The framework includes a further elongated tube or pipe for each of the elongated tubes making up the base portions with each of the further elongated tubes or pipes being sized and configured to be slidably receivable within an upwardly or downwardly facing opening of a respective one of the elongated tubes. In this way, the further upper section of the elongated tubes or pipes may easily be removed from the base portion elongated tubes when it is desired to remove the inventive detachable tee-top from the associated vessel. In a fixed position, the upper and lower elongated tubes are secured with an inner core tube held together by a pullpin.

(3) The further elongated tubes or pipes comprise part of the framework of the inventive detachable tee-top and also includes a generally horizontally oriented support frame for a cover that may, if desired, be made of a canvas such as is made under the Trademark "SUNBRELLA". High speed straps are attached to this support frame and attached to the base portions of the inventive framework to prevent distortion of the elongated tubes or pipes at high wind speeds. The support frame is thus not subject to wind stress at high boat speeds.

(4) In a first embodiment of the present invention, the inventive framework includes a simple configuration of elongated tubes extending from the further elongated tubes or pipes to the generally horizontally oriented top support frame, which top support frame includes a single centrally disposed horizontal brace. In a second larger embodiment, a second centrally disposed horizontal brace is provided parallel to the first-mentioned horizontal brace and additional elongated tubes are provided between the further elongated tubes and this extra horizontal brace to provide extra support and strength.

(5) In each embodiment of the present invention, a fastening system is provided for the canvas cover that extends over the horizontally directed support frame. In this regard, in the preferred embodiments of this cover which is suitably employed in both embodiments of the present invention, one end of the cover is fastened at one end of the support frame. The cover may be unrolled from that location and extended over the remainder of the support frame whereupon elastic straps may be stretched and extended to a desired configuration to hold the cover in its assembled configuration. When it is desired to roll the cover up when one is storing the inventive detachable top, the elastic strap is easily disconnected for this purpose.

Accordingly, it is a first object of the present invention to provide a detachable tee-top for a boat center console.

It is a further object of the present invention to provide such a device including a base portion that may be permanently fastened to the sides of a center console of a boat.

It is a further object of the present invention to provide such a device wherein a horizontally directed support frame for a cover is mounted on portions of a framework removably attachable to the base portion of the device.

It is a still further object of the present invention to provide such a device in two embodiments with one of the embodiments having a single horizontal brace on the cover support frame and with a second larger embodiment having a plurality of such horizontal braces.

It is a still further object of the present invention to provide such a device wherein the flexible cover thereof may be rolled up when not in use and may be unrolled and stretched to a covering configuration as desired.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
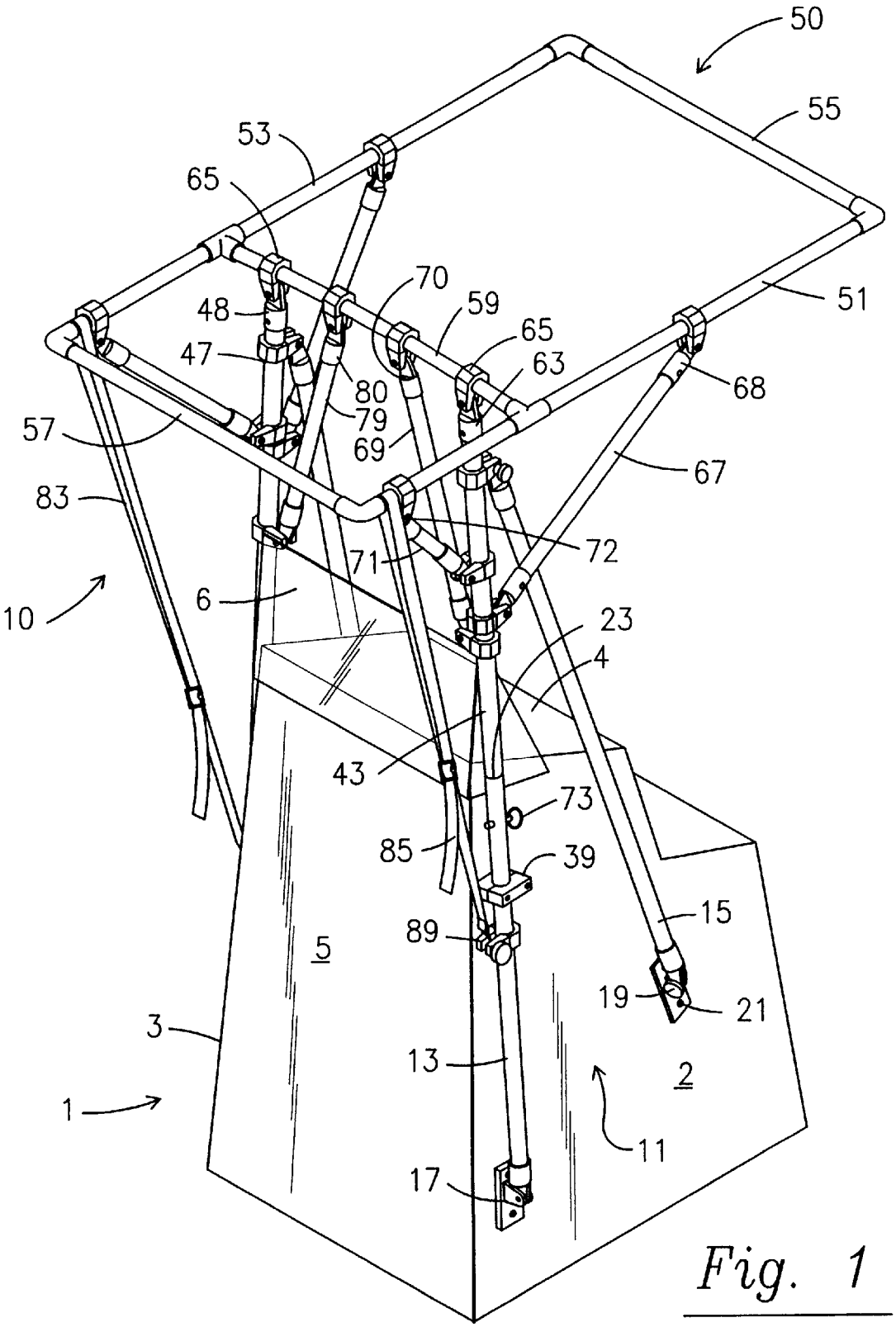
FIG. 1 shows a perspective view of the framework of a first embodiment of the present invention with the cover thereof omitted to allow showing of details.

With reference, first, to FIGS. 1–5, a first embodiment of the present invention will now be described. First, a center console of an associated vessel is generally designated by the reference numeral 1 and is seen to include side walls 2 and 3, a top 4, and a front wall 5 with a windshield 6. The first embodiment of the present invention is generally designated by the reference numeral 10.

The device 10, as seen in FIG. 1, includes a base portion 11 consisting of elongated tubes 13 and 15 having respective fittings 17 and 19 attached at their bottom terminations allowing permanent fastening to the side wall 2 of the center console 1 by any suitable means such as threaded fasteners 21. The tube 13 terminates at the upper location of reference numeral 23. The tube 15 is removed by withdrawing thumb screws.

Figure 2:
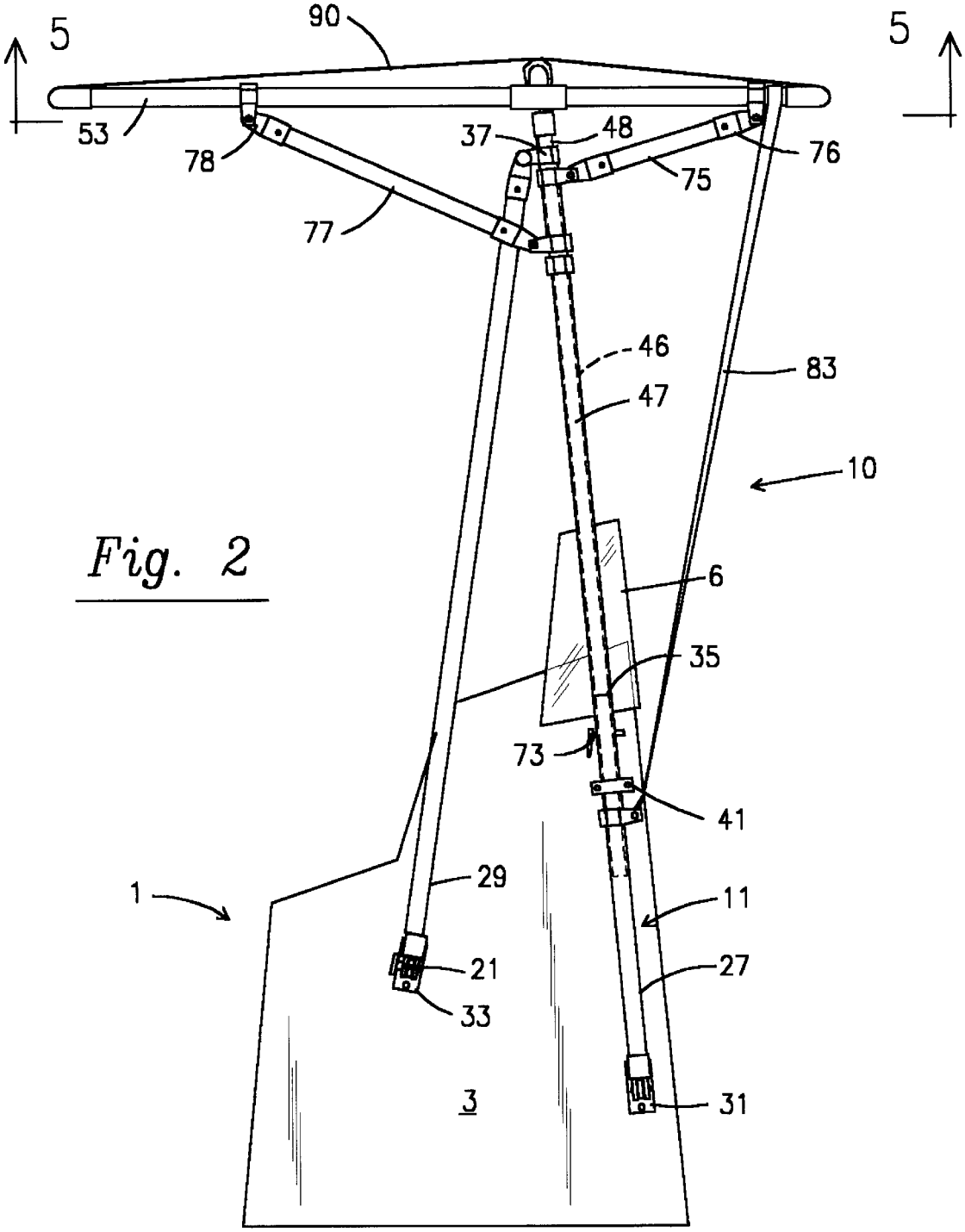
FIG. 2 shows a side view of the embodiment of FIG. 1.

In FIG. 2, the base portion 11 is seen to include further elongated tubes 27 (corresponding to the tube 13) and 29 (corresponding to the tube 15) having respective fittings 31 and 33 that are permanently fastened to the side wall 3 of the center console 1 of the associated vessel through suitable means such as the fasteners 21. The upward extent of the tube 27 is depicted by the upwardly facing opening 35. Tube 29 is removed at its upper termination 37.

With reference to FIGS. 1 and 2, the block-like members 39 and 41 clamped about the tubes 13 and 27, respectively, have flat inner surfaces engaging the walls 2 and 3, respectively, to appropriately space the tubes 13 and 27 therefrom. This aspect is also clearly seen with reference to FIG. 3.

Figure 3:
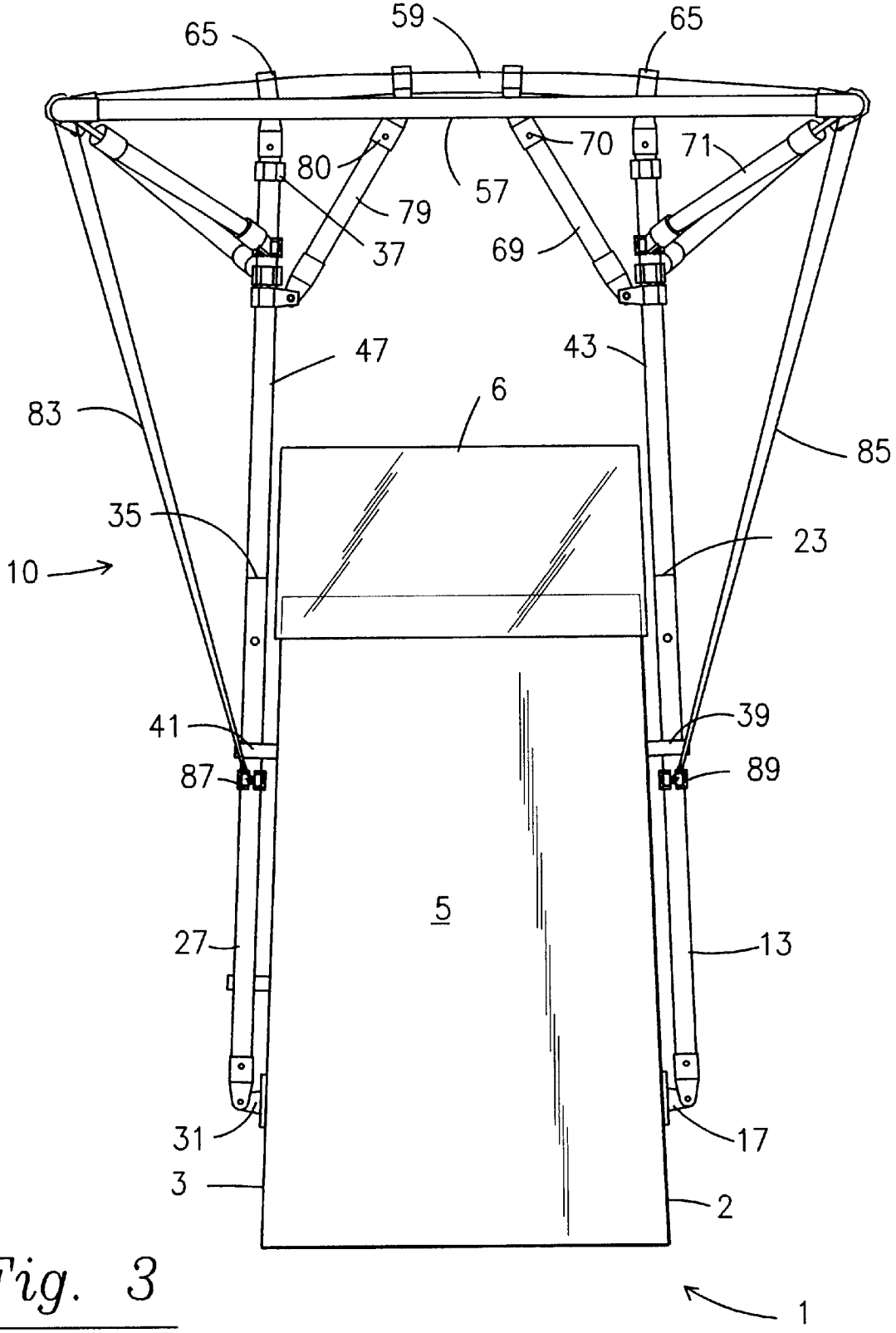
FIG. 3 shows a front view of the first embodiment of the present invention.

With reference to FIGS. 1–3, in particular, further elongated tubes or pipes are provided having lower ends receivable within openings defined by the upper terminations of the tubes 13, 15, 27 and 29. Thus, the tube or pipe 43 has a lower end received within the opening defined by the upper termination 23 of the tube 13. Similarly, the tube or pipe 47 has a lower end received within the upwardly facing opening 35 of the tube 27. In each case, if desired, the lower end of these further elongated tubes or pipes 43, and 47 may have fixedly inserted therein a piece of tubing, for example, the piece of tubing 46 shown in phantom in FIG. 2, having the same outer diameter as the inner diameter of the upwardly facing openings of the respective tubes 13, and 27 so that the further elongated tubes or pipes may easily be coupled to the first-mentioned elongated tubes 13, and 27 merely by sliding these pieces of tubing, i.e., the tubing 46, within the upwardly facing openings of the tubes 13 and 27. The tubing 46 is held in position by pull pin 73. The loose sliding fit between the short pieces of tubing 13 and 17 and the elongated tubes or pipes 43 and 47 allows easy removal of the elongated tubes 43 and 47 when it is desired to remove the inventive detachable tee-top from its covering configuration over the center console of the associated vessel.

Figure 4:
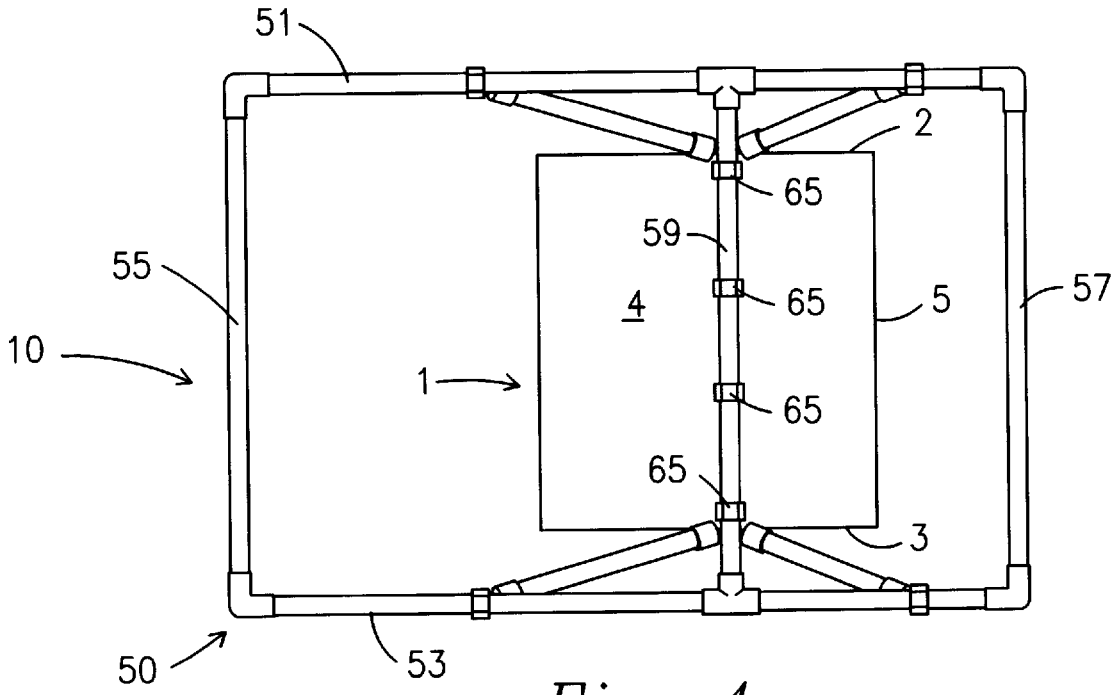
FIG. 4 shows a top view of the first embodiment of the present invention.

As seen, in particular, in FIGS. 1 and 4, the first embodiment of the present invention includes a horizontally directed support frame 50 that is generally rectangular in configuration having side portions 51 and 53, end portions 55 and 57, and a single centrally disposed horizontal brace 59.

As seen in FIG. 1, the elongated tube or pipe 43 has an upward end 63 attached to the brace 59 through a clamping member 65. Additionally, further elongated bracing tubes 67, 69 and 71 each have one end clamped to the tube or pipe 43 by a clamping member 65 and an upper end clamped to a structure of the horizontally directed support frame 50 by a clamping member 65. Thus, the tube 67 has an upper end 68 clamped to the side portion 51 of the horizontally directed support frame 50. The tube 71 has an upper end 72 clamped to the same side portion 51 while the tube 69 has an upper portion 70 connected to the horizontal brace 59. With reference to FIG. 2, the elongated tube or pipe 47 has an upper end 48 clamped to the horizontal brace 59. A further tube 75 has an upper end 76 clamped to the side portion 53 of the horizontally directed support frame 50. A further tube 77 has an upper portion 78 clamped to the same side portion 53 of the frame 50 and, with reference back to FIG. 1, a further tube 79 has an upper portion 80 connected to the horizontal brace 59.

As shown in the drawings, a pivoting connection is provided between each clamping member 65 and the associated end of the elongated tube to which it is attached to allow adjustment of the degree of pivoting to enhance the ease of assembly of the inventive device.

As shown in FIGS. 1 and 3, in particular, high speed straps 83 and 85 are looped over the side portions 53 and 51, respectively, of the frame 50 and are attached to respective fittings 87 and 89 clamped to the elongated tubes 27 and 13, respectively. These high speed straps 83 and 85, when fastened in the manner shown, preclude distortion of the tubes or pipes 43 and 47 from the respective tubes 13 and 27. When it is desired to remove the tubes 43 and 47 from the respective tubes 13 and 27, all one must do is unhook the straps 83 and 85 from their fittings 87 and 89 and lift the tubes or pipes 43 and 47 upwardly from the respective tubes 13 and 27 while detaching tubes 15 and 19 by thumb screws from their fittings 17 and 33 respectively.

Figure 5:
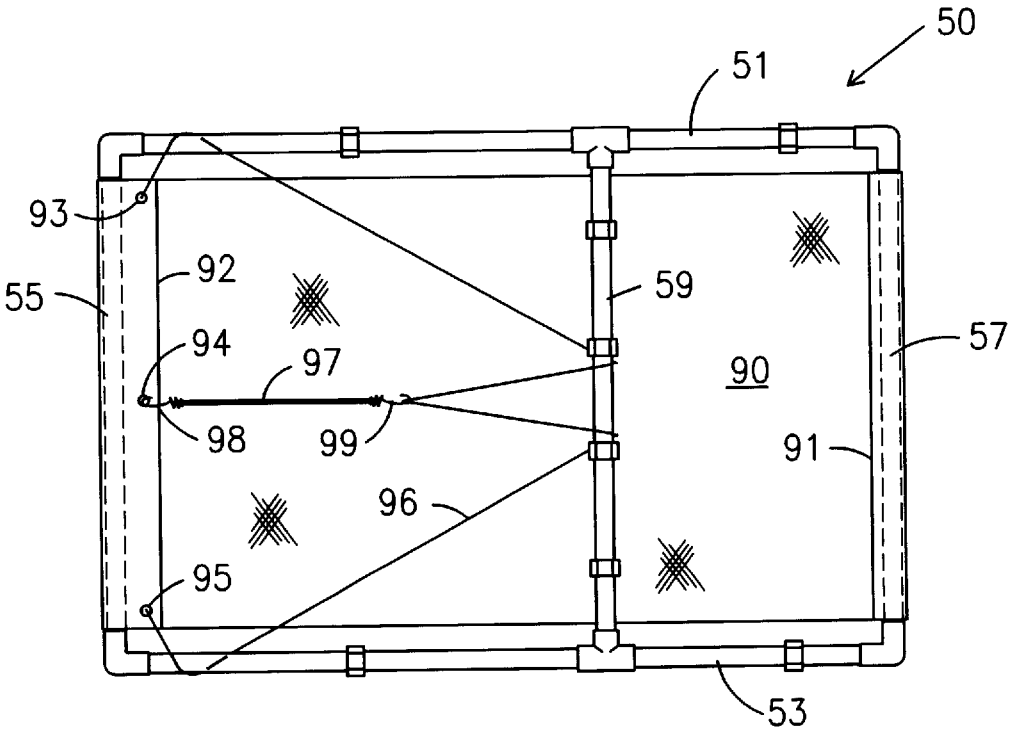
FIG. 5 shows a bottom view from just above the center console of the associated vessel showing details of the underside of the cover.
Figure 6:
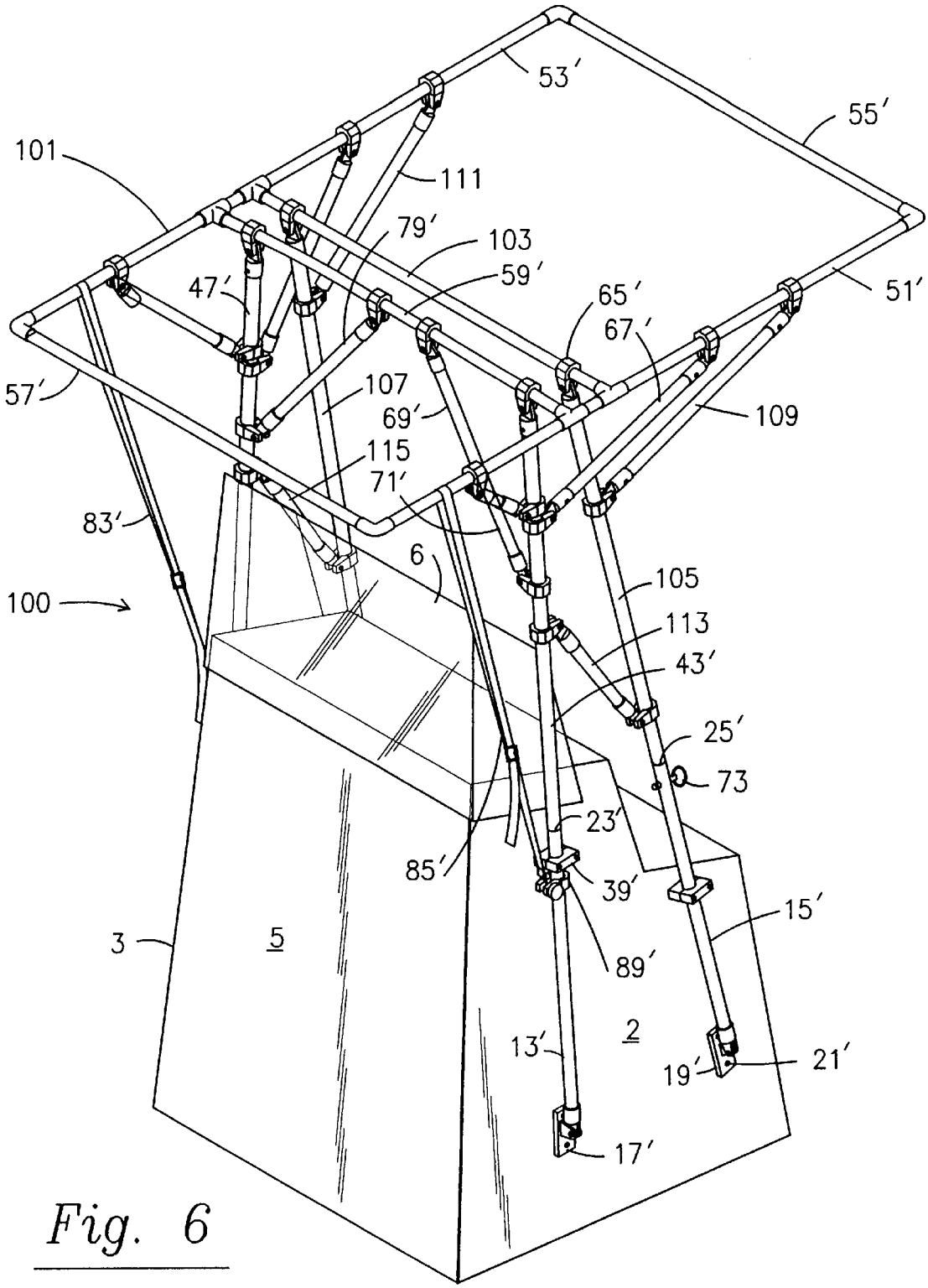
FIG. 6 shows a perspective view similar to that of FIG. 1 but showing a second embodiment of the present invention.
Figure 7:
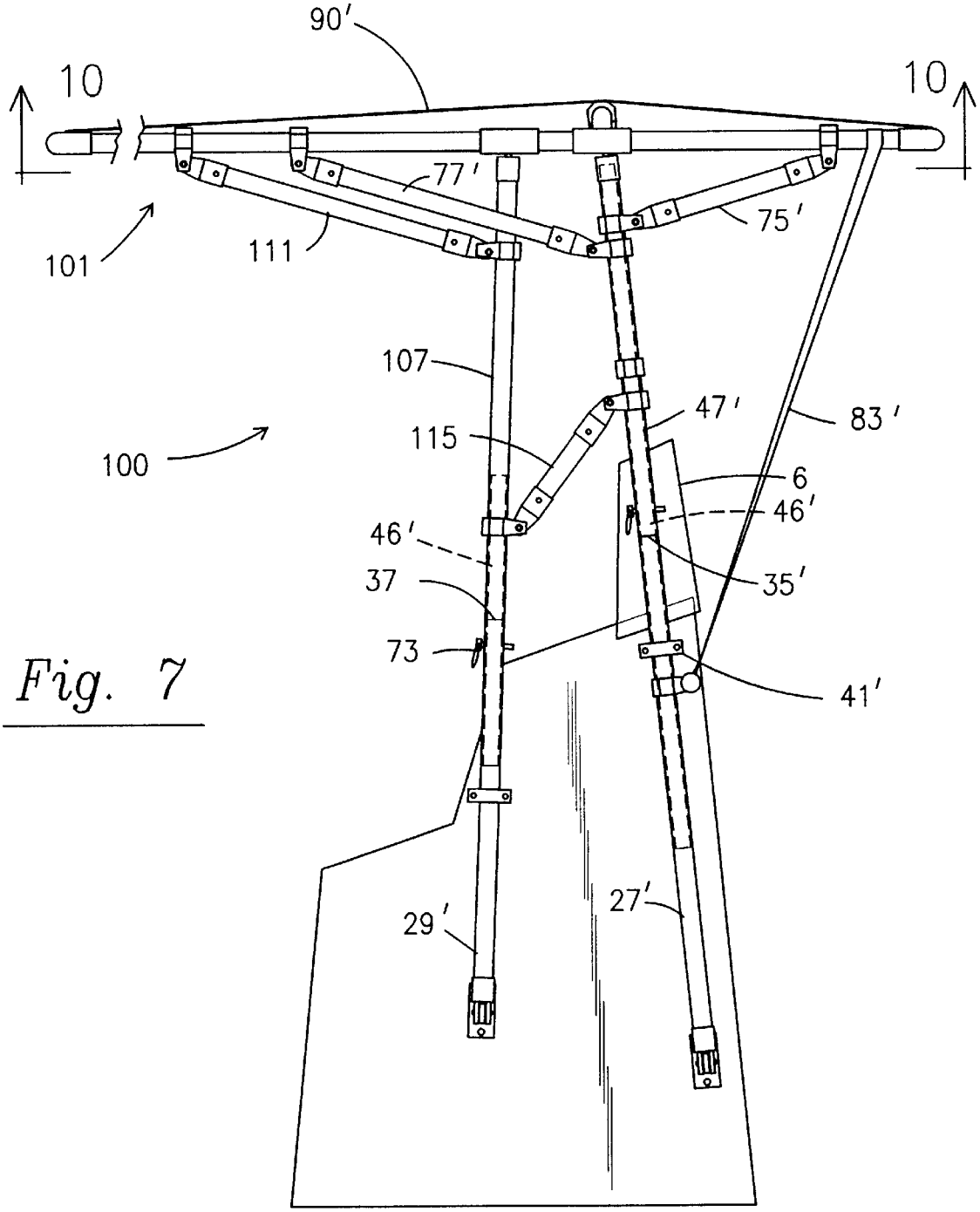
FIG. 7 shows a side view of the second embodiment of the present invention.
Figure 8:
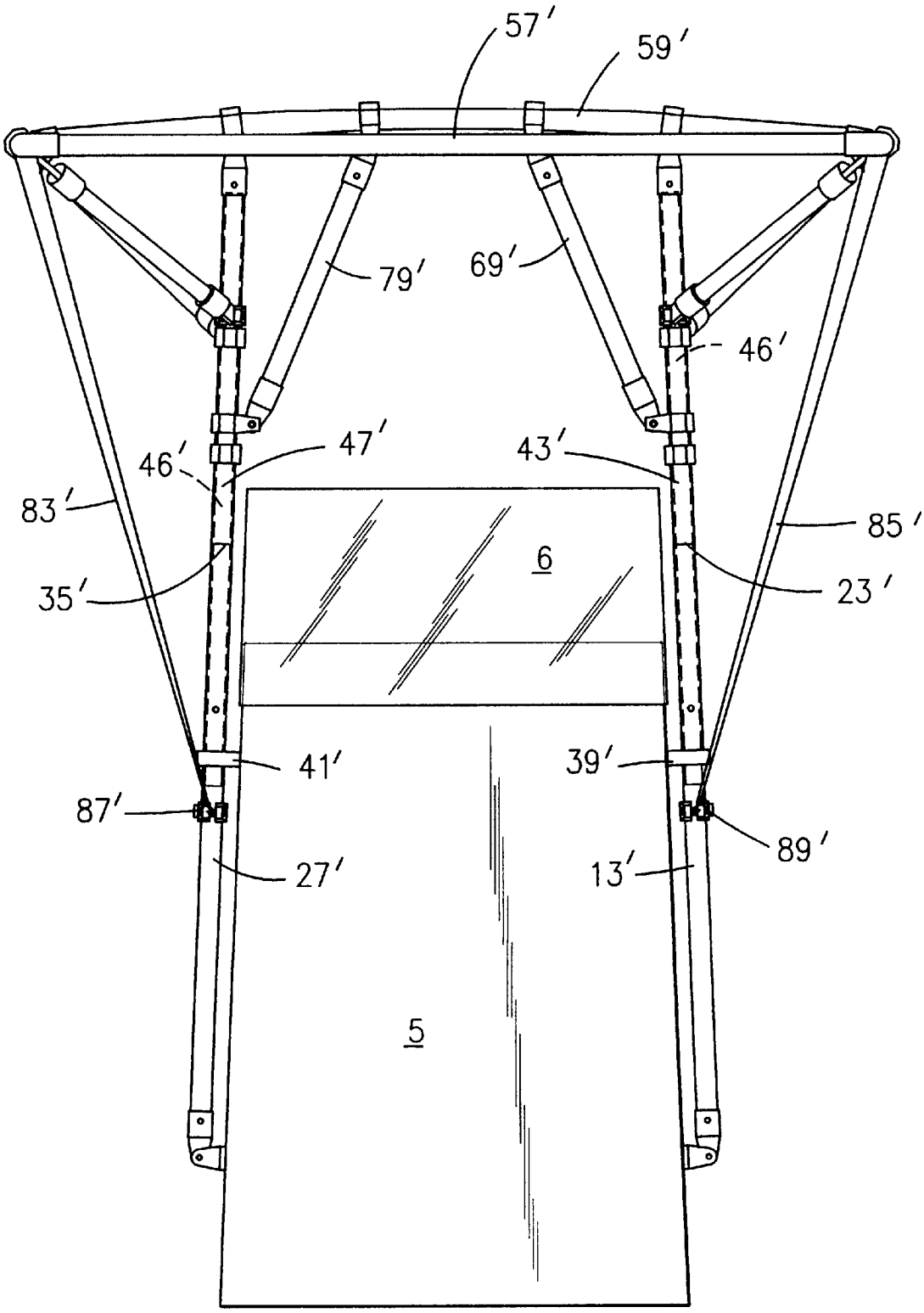
FIG. 8 shows a front view of the second embodiment of the present invention.

With reference to FIG. 5, it is seen that a cover 90 is fixed over the tube 57 of the frame 50 through any suitable means such as overlapping the fabric thereof and sewing at the stitching 91. The other end of the cover 90 has an edge 92 that may be draped over the tube 55. Adjacent the edge 92, holes 93, 94 and 95 are provided. A non-elastic strap 96 extends between the holes 93 and 95 and a spring cord 97 has one hook 98 fastened in the hole 94 and a second hook 99 that may be attached through a loop formed in the non-elastic cord 96 after it has been draped over the brace 59 in the manner shown in FIG. 5 to hold the cover 90 in assembled configuration. When it is desired to disassemble the cover 90, all one must do is unhook the hook 99 from the cord 96 whereupon the cover 90 may be rolled up over the tube 57 and suitably fastened.

In a preferred aspect one end of the cover 90 is bound and sewn to itself forming a 3 inch circle. The horizontal support 57 is then threaded through the circle and thus the cover 90 is permanently attached to the frame. The cover may be rolled or unrolled from that location and extended over the remainder of the support frame. At the other end of the cover a length of rope 96 attached to each comer creates a loop which encircles the outside comers of the frame whereupon an elastic strap 97 is attached to the loop and stretched and extended as appropriate to hold the cover 90 in its assembled configuration. The elastic strap 97 allows the top to respond to the force of the wind and dissipate those forces without transferring the attendant stresses to the frameworks.

With reference, now, to FIGS. 6–10, a second embodiment of the present invention will now be described. In the embodiment of FIGS. 6–10 as compared to the embodiment of FIGS. 1–5, like elements are shown using like primed reference numerals. The same center console is shown using the same reference numerals. The description of the elements in the second embodiment depicted with like primed reference numerals has already been made with respect to the embodiment illustrated in FIGS. 1–5.

The embodiment described in FIGS. 6–10 is generally referred to by reference numeral 100. The device 100 differs from the device 10 in several respects. First, the device 100 is recommended for boats about 18 to 23 feet long whereas the device 10 is recommended for smaller boats. Secondly, the horizontally directed support frame 101 thereof includes a second horizontal brace 103 in addition to the horizontal brace 59'.

The upwardly open end 25 of the tube 15' receives an elongated tube or pipe 105 that has an upper end clamped to the horizontal brace 103 with a clamping member 65'. In contrast, in the embodiment of FIGS. 1–5, the tube 15 is clamped to an upper fitting. Similarly, a tube or pipe 107 is coupled to the upwardly open end 37 of the tube 29' and has an upper end clamped to the extra horizontal brace 103.

Figure 9:
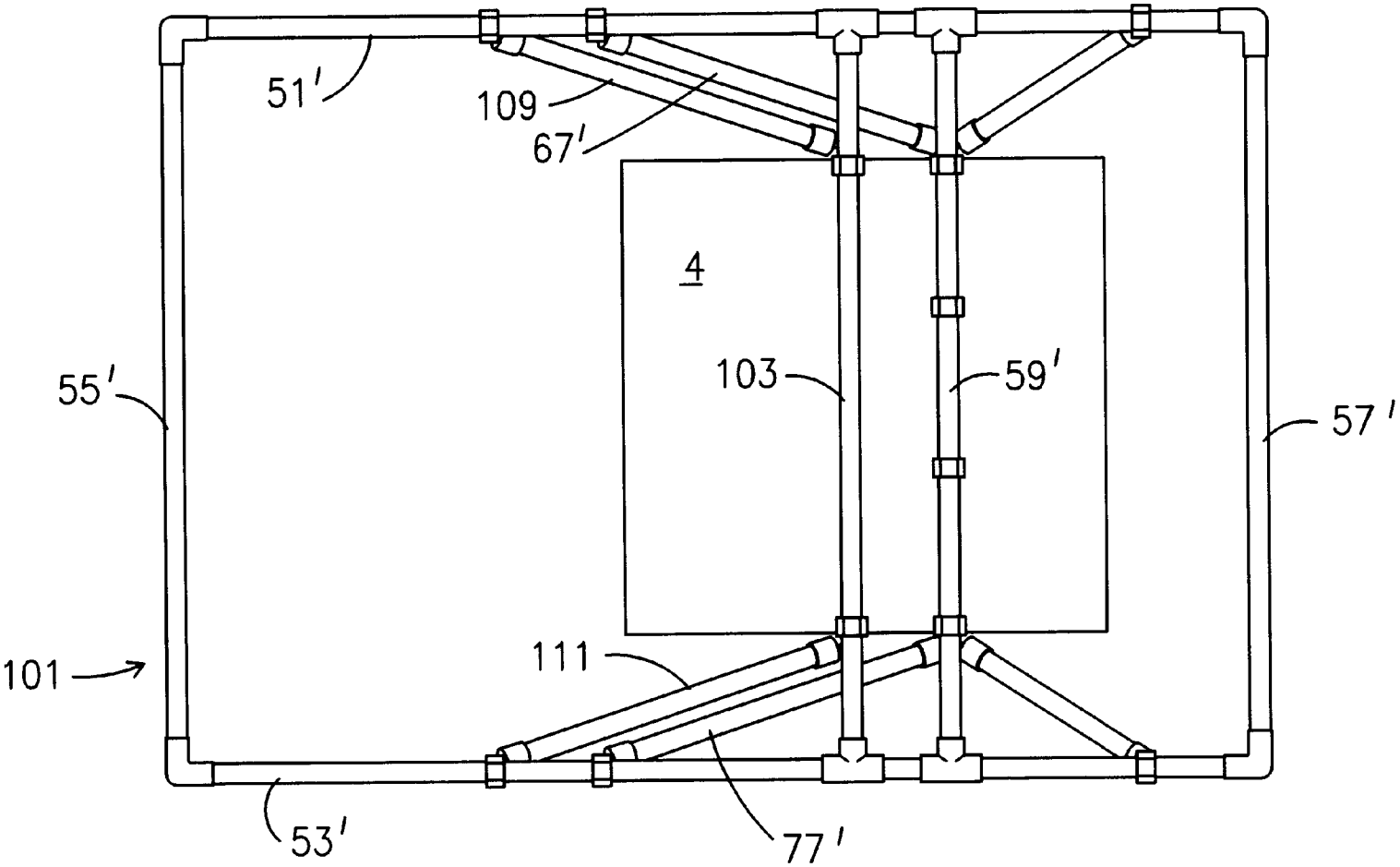
FIG. 9 shows a top view of the second embodiment of the present invention.

In a further aspect, an elongated tube 109 extends between the tube 105 and the side tube 51' of the horizontally directed support frame 101. Similarly, an elongated tube 111 extends between the tube 107 and the side portion 53' of the frame 101. FIG. 9 shows a top view of the second larger embodiment of the present invention showing the relationship between the various tubes.

In another further aspect, an elongated tube 113 is clamped between the tubes 105 and 43' while an elongated tube 115 is clamped between the elongated tubes 107 and 47'.

Figure 10:
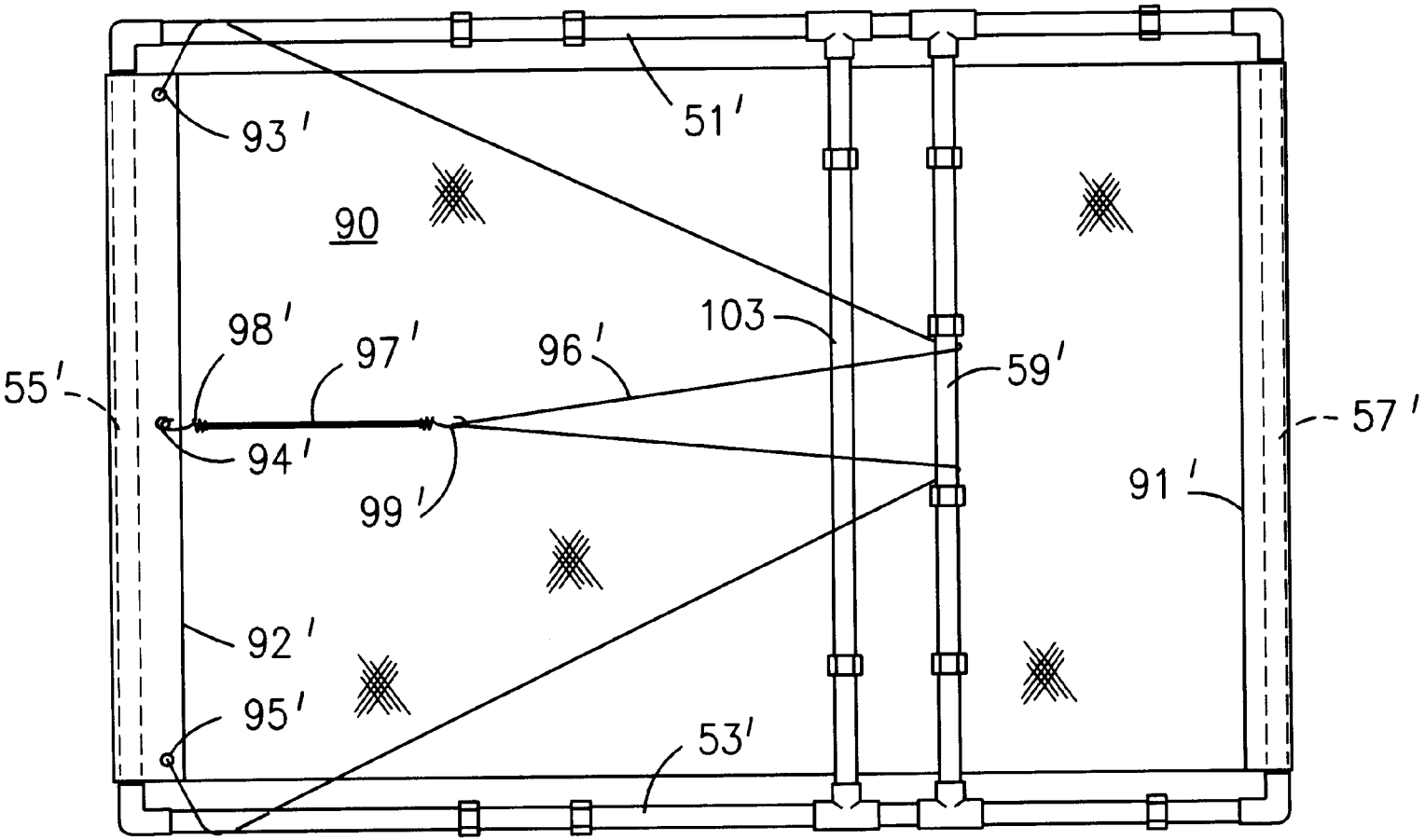
FIG. 10 shows a bottom view of the second embodiment of the present invention from just above the center console of the associated vessel showing details of the underside of the cover.

In comparing FIGS. 5 and 10, it is seen that the sole difference consists of the fact that in FIG.5, the loop of the cord 96 is draped over the brace 59 whereas in FIG. 10, the loop of the cord 96' is draped over the brace 103.

In the embodiment of FIGS. 6–10, the elastic straps 83' and 85' are fastened by looping them over the side portions 53' and 51', respectively, of the frame 101. The fittings 87' and 89' receive the lower ends of the respective straps 83' and 85' to allow holding of the frame 101 and associated tubes in assembled relation on the base portion consisting of the tubes 13', 15', 27' and 29' that are securely fastened to the side walls of the center console 1 through the use of suitable fasteners such as, for example, the fasteners 21'.

In the embodiments of the present invention, the tubes may suitably be made of polished aluminum, either in double wall strength or single wall strength depending upon the application. The inner core 46 or 46' is made from aluminum. The fasteners 21, 21' as well as fasteners employed in the clamping members 65 and 65' may be made of aluminum, stainless steel or other corrosion resistant materials. The top 90, 90' may be made of any suitable canvas or plastic material such as nylon with the preferred material being either "SUNBRELLA 1" or "SUNBRELLA 2" with the latter product consisting of "SUNBRELLA 1" with a rubberized coating on the underside thereof to enhance the waterproof nature thereof. The support frame is angled to present the smallest possible profile to the wind as the associated boat is underway to reduce lift forces to an absolute minimum.

As such, an invention has been disclosed in terms of preferred embodiments thereof, which fulfill each and every one of the objects of the invention as set forth hereinabove, and provide a new and useful portable tee-top for boat center console of great novelty and utility.

Of course, various changes, modifications and alterations in the teachings of the present invention may be contemplated by those skilled in the art without departing from its intended spirit and scope:

As such, it is intended that the present invention only be limited by the terms of the appended claims.

I claim:

1. A tee-top attached to a center console of a boat, the center console having a first side wall and a second side wall opposed to said first side wall, and a front wall and rear wall, the top comprising:

a) a first base portion mounted on said first side wall and a second base portion mounted on said second side wall, each base portion including at least one tube having an upwardly facing opening;

b) a horizontally directed frame having a front portion and rear portion and a first side portion and a second side portion, the frame carrying a flexible cover fixedly attached to said front portion and removable attachable to said rear portion;

c) support means connected to said frame including a first tube depending downwardly from one side of said frame and a second tube depending downwardly from another side of said frame;

d) coupling means for releasably coupling (1) said first tube to a tube of one of said base portions and (2) said second tube to a tube of another of said base portions;

e) fastening means releasably connected between said horizontally directed frame and said first base portion and second base portion for preventing disconnection of said coupling means;

f) whereby release of said fastening means permits free removal of said support means from said base portions.

2. The tee-top of claim 1, wherein said at least one tube of each base portion comprises two tubes, said support means first tube comprising a first pair of pipes and said support means second tube comprising a second pair of pipes.

3. The tee-top of claim 1, wherein said horizontally directed frame is generally rectangular with the first side portion and a second side portion having a greater length than the front portion and a rear portion.

4. The tee-top of claim 3, wherein said cover has a front end sewn to itself to form a circle and is fixedly attached around said front portion and a rear end is removably attachable to said rear portion of the frame with an elastic cord.

5. The tee-top of claim 4, wherein said cover has a rear edge at the rear end having three spaced holes therethrough, a non-elastic cord attached to two of said holes adjacent opposed comers of said rear edge and the elastic cord attached to a hole located centrally along said rear edge.

6. The tee-top of claim 5, said horizontally directed frame including a brace between and parallel with said front and rear portions, said non-elastic cord being looped around said brace and then attached to said elastic cord to hold said cover over said horizontally directed frame.

7. The tee-top of claim 6, further including a further brace on said frame parallel to said first-mentioned brace.

8. The tee-top of claim 2, wherein said support means first tube comprises four first pipes and said support means second tube comprises four second pipes, said four first pipes being coupled to said first base portion two tubes and said four second pipes being coupled to said second base portion two tubes.

9. The tee-top of claim 1, wherein said fastening means comprises a first strap at a bottom end attached to the first base portion and a second strap at a bottom end attached to the second base portion and the first and second strap attached at a top end to the horizontally directed frame.

10. The tee-top of claim 9, wherein each base portion includes a fitting, one of said elastic straps being releasably attachable to a respective one of said fittings.

11. The tee-top of claim 2, wherein said first pair of pipes are interconnected.

12. The tee-top of claim 11, wherein said second pair of pipes are interconnected.

13. The tee-top of claim 2, wherein each pipe of said first pair of pipes is individually coupled to said frame.

14. The tee-top of claim 13, wherein each pipe of said second pair of pipes is individually coupled to said frame.

15. The tee-top of claim 14, wherein said frame includes two parallel braces.

16. The tee-top of claim 12, wherein said frame includes a single brace.

17. A tee-top attached to a center console of a boat, the center console having a first side wall and a second side wall opposed to said first side wall, the top comprising:

a) a first base portion mounted on said first side wall and a second base portion mounted on said second side wall, each base portion including two tubes, each having an upwardly facing opening;

b) a horizontally directed frame carrying a flexible cover, said frame being generally rectangular with front and rear portions and right and left side portions with a brace between each side portion, said cover being fixedly attached to said front portion and removably attachable to said rear portion, said cover having a rear edge having three spaced holes therethrough, a non-elastic cord attached to two of said holes adjacent opposed comers of said rear edge and an elastic cord attached to a hole located centrally along said rear edge, said brace being parallel with said front and rear portions, said non-elastic cord being looped around said brace and then attached to said elastic cord to hold said cover over said frame;

c) support means connected to said frame including a first pair of pipes depending downwardly from one side of said frame and a second pair of pipes depending downwardly from another side of said frame;

d) coupling means for releasably coupling (1) said first pair of pipes to said first base portion tubes and (2) said second pair of pipes to said second base portion tubes;

e) fastening means releasably connected between said frame and said first base portion and second base portion for preventing disconnection of said coupling means, said fastening means comprising a first strap and a second strap, each base portion including a fitting allowing removable attachment of one of said straps;

f) whereby release of said straps permits free removal of said support means from said base portions.

18. The tee-top of claim 17, wherein said first pair of pipes are interconnected and said second pair of pipes are interconnected.

19. The tee-top of claim 17, wherein each pipe of said first and second pair of pipes is individually coupled to said frame.

20. The tee-top of claim 17, wherein said frame includes two parallel braces.

* * * * *